US012398975B1

(12) United States Patent
Butterfield

(10) Patent No.: US 12,398,975 B1
(45) Date of Patent: Aug. 26, 2025

(54) TRIGGER ASSEMBLY FOR AIR GUN

(71) Applicant: Crosman Corporation, Bloomfield, NY (US)

(72) Inventor: Ethan T. Butterfield, Ontario, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 18/504,956

(22) Filed: Nov. 8, 2023

(51) Int. Cl.
*F41B 11/00* (2013.01)
*F41B 11/62* (2013.01)
*F41B 11/70* (2013.01)

(52) U.S. Cl.
CPC ..... *F41B 11/70* (2013.01); *F41B 11/62* (2013.01)

(58) Field of Classification Search
CPC ..... F41B 11/646; F41B 11/70; F41B 11/62; F41A 17/46; F41A 19/16; F41A 19/33; F41A 19/56; F41A 3/40; F41A 3/76; F41A 7/06
USPC ..... 24/67; 124/37, 71, 40, 48, 51.1; 89/1.1, 89/152; 42/75.03
See application file for complete search history.

(56) References Cited

U.S. PATENT DOCUMENTS 861,939 A * 7/1907 Benet et al. ..... F41A 19/33 89/142
1,294,892 A * 2/1919 Fox et al. ..... F41A 3/40 89/33.02
1,396,404 A * 11/1921 Burton ..... F41B 11/647 124/40
1,886,561 A * 11/1932 Lefever ..... F41B 11/646 124/67
3,464,399 A * 9/1969 Hordley ..... F41B 11/646 124/40
3,561,319 A * 2/1971 Joyce ..... F41A 9/23 42/59
4,899,717 A * 2/1990 Rutten ..... F41B 11/71 124/66

* cited by examiner

*Primary Examiner* — Michael D David
(74) *Attorney, Agent, or Firm* — Lee & Hayes, P.C.

(57) ABSTRACT

A trigger assembly includes an actuator that moves along a longitudinal axis, a primary sear, a catch, a trigger, and a secondary sear. After releasing the actuator to fire the air gun, the actuator engages the primary sear, which cooperates with the secondary sear and the catch to facilitate automatic re-cocking of the air gun.

15 Claims, 9 Drawing Sheets

TRIGGER ASSEMBLY FOR AIR GUN

BACKGROUND

Air guns are used for a variety of recreational purposes. Some conventional air guns include a tank or reservoir that is charged (e.g., pre-charged) to provide a number of shots before re-charging. These pre-charged pneumatics (PCPs) are able to supply air "on-demand," e.g., for ready firing. Because compressed air is readily available on PCPs, those air guns may be configured for rapid firing, such as semi-automatic firing. Thus, there is a need in the art for an improved trigger assembly, which may be used with a PCP or other type of on-demand air gun and that facilitates self-cocking and/or semi-automatic firing of projectiles.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

DETAILED DESCRIPTION

Figure 1:
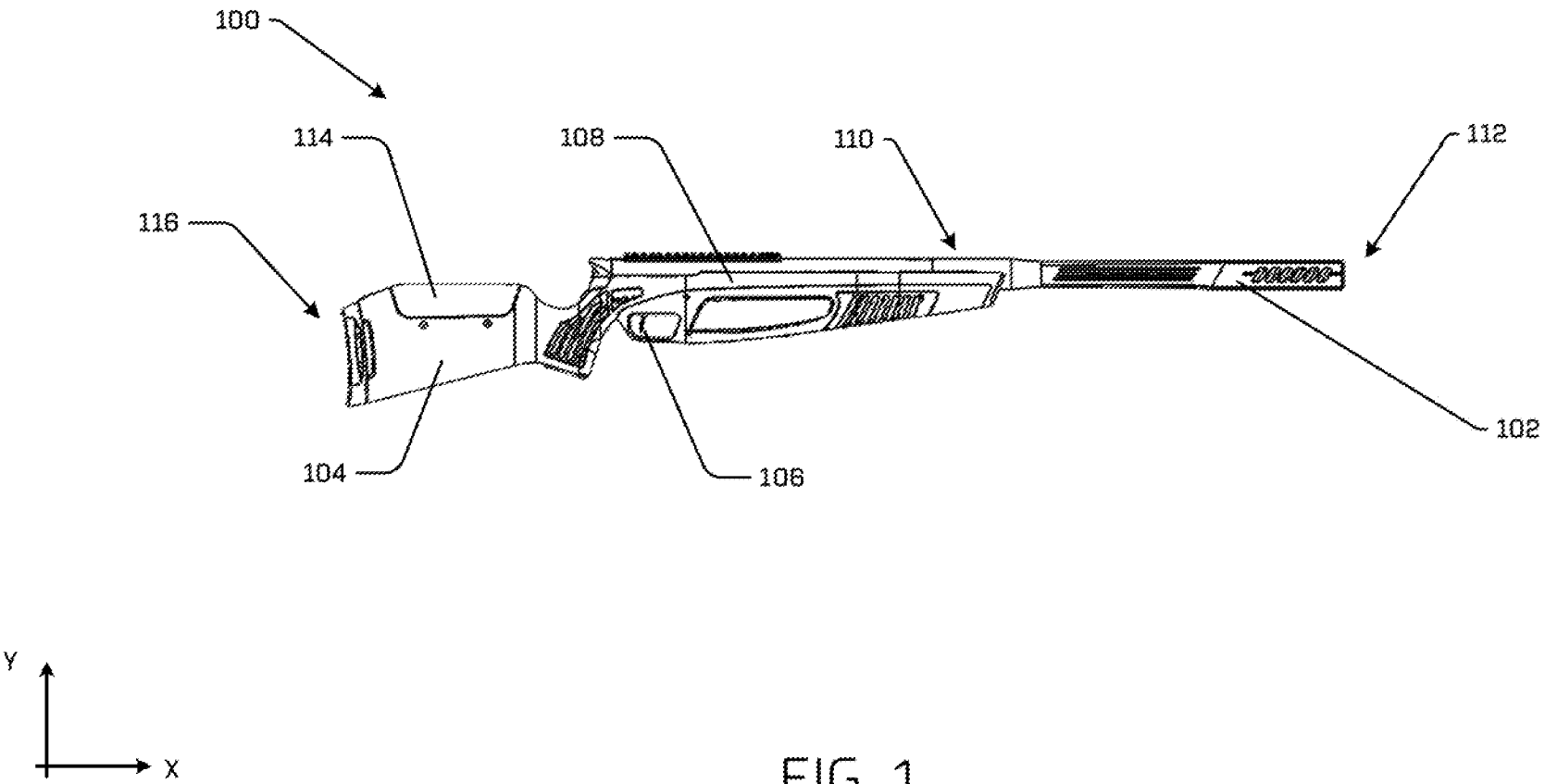
FIG. 1 is side view of an example air gun according to example implementations of this disclosure.

This application relates to a trigger assembly for use with an air gun or other projectile launching device. In examples, trigger assemblies disclosed herein may be used in a pre-charged pneumatic (PCP) air gun. The systems and techniques described herein may provide for automatic re-cocking of a trigger assembly, e.g., to facilitate semi-automatic firing of the air gun including the trigger assembly.

In aspects of this disclosure, a trigger assembly includes a trigger, a primary sear configured to rotate about a first pivot, a secondary sear configured to rotate about a second pivot, and a catch configured to rotate about a third pivot. During cocking of the air gun, a firing actuator, such as a hammer, is moved to a cocked position, e.g., against a biasing force of a firing spring. In the cocked position, the primary sear engages the hammer, and the secondary sear is positioned to resist a force applied on the primary sear by the firing spring, e.g., via the hammer. From the cocked position, the trigger assembly is ready for firing.

The trigger is pulled to fire the air gun. In examples, the trigger includes a trigger extension or similar surface that contacts the secondary sear, causing the secondary sear to rotate, out of engagement with the primary sear. Once the secondary sear is disengaged from the primary sear, the primary sear is no longer able to retain the hammer in the cocked position. The hammer advances in a firing direction under the biasing force of the firing spring, moving the primary sear out of a path of travel of the hammer. Continued movement of the hammer causes the hammer to impact a valve stem or similar firing member that results in a rush of compressed air into a firing chamber, to fire a projectile from the air gun.

After firing, the hammer recoils. In examples, the force of the recoil is sufficient to compress the firing spring such that the hammer returns to a position corresponding to the seared or cocked position, e.g., a re-seared or re-cocked position. In this re-seared or re-cocked position, the primary sear again blocks advancement of the hammer, and the catch, separate from the secondary sear, engages the primary sear to counter the biasing force applied to the primary sear by the hammer/firing spring. For example, the trigger is retained in the actuated, pulled, or firing position such that the secondary sear remains disengaged from the primary sear during the recoil and re-searing or re-cocking.

When the trigger is released, a trigger return spring biases the trigger back to the unpulled or normal state. This return of the trigger causes the secondary sear to return to a position to support the primary sear. The return of the trigger also causes the catch to disengage from the primary sear. The result is that, with the trigger fully returned to the neutral or unfired position, the trigger assembly is arranged in the cocked position, and ready to fire another projectile.

Thus, systems and techniques described herein may facilitate automatic re-cocking of the trigger assembly. For example, aspects of this disclosure describe arrangements in which a firing actuator is re-seared automatically after firing, when the trigger is retained in the pulled or firing position. For example, the catch may retain the primary sear in a blocking position, e.g., to maintain the hammer in the cocked position, until the trigger is returned to the firing position. The return of the trigger to the firing position causes a "handoff" of the primary sear from the catch to the secondary sear, to place the trigger assembly in the cocked position.

Specific examples of this disclosure are provided below with reference to the figures. Although the specific examples described reference use of a trigger assembly with a PCP air gun, aspects of this disclosure can be used with other types of air guns. Without limitation, the trigger assemblies described herein may provide action for any number of projectile launchers.

FIG. 1 illustrates an example PCP air gun 100 according to aspects of this disclosure. More specifically, FIG. 1 is a side view of one implementation of the air gun 100, which includes a trigger assembly for self-cocking and firing via an improved trigger assembly. FIG. 1 illustrates the air gun 100 as generally including a barrel 102, a stock 104, and a trigger 106. The air gun 100 also includes a housing 108 extending generally between the barrel 102 and the stock 104. The housing 108 may retain and/or conceal components of the air gun 100, including a trigger assembly, which includes the trigger 106. Without limitation, aspects of this disclosure include components for self- or automatic-cocking of the air gun 100 using the trigger assembly, which may be disposed in, attached to, or otherwise associated with the housing 108. In aspects of this disclosure, the housing 108 may be any portion of the air gun 100 that contains, retains, mounts, or otherwise couples to other aspects of the air gun. In some examples, the housing may be a portion of the air gun 100 that conceals, covers, and/or shrouds other aspects of the air gun. For example, the housing 108 can include some or all of the stock 104, the barrel 102, and/or a central body of the air gun between the stock 104 and/or the barrel.

The barrel 102 extends generally from a breech end 110 to a muzzle end 112. Although not illustrated in FIG. 1, a bore extends through the barrel 102, from the breech end 110 to the muzzle end 112. The bore provides a hollow interior space within the barrel 102 through which compressed air and a projectile, such as a pellet, can pass, as will be described in greater detail below. The barrel 102 is sufficiently strong to contain high pressure gasses introduced into the barrel 102 to fire the projectile. In implementations, the bore may be smooth, or the bore may be rifled, e.g., to impart a stabilizing spin on the projectile as it passes through the bore.

The stock 104 may be any conventional size or shape. In some instances, the stock 104 may be removably secured to the housing, e.g. to promote removal and/or replacement of the stock 104. Moreover, removal of the stock 104 may facilitate access to an interior of the housing 108, e.g., to service working components of the air gun 100. The stock 104 may also house a battery or other power source, a control system adapted to receive inputs from sensors and/or to generate outputs that drive motors, actuators, lights, solenoids, motors, linear actuators and/or other electronic, mechanical, electromechanical, sonic, electrooptical, and/or other components. Without limitation, the stock 104 may comprise a portion of the housing 108.

The trigger 106 may be any lever, button, or the like, configured for user interaction to fire the air gun 100. As detailed further herein, in some instances the trigger 106 is a part of a trigger assembly that, among other features, facilitates semi-automatic firing and/or self-cocking of the air gun 100. A trigger assembly including the trigger 106 may also or alternatively prevent firing of the air gun 100 while the air gun 100 is presenting a new projectile for firing, e.g., after firing a projectile.

The housing 108 is generally provided to contain components of the air gun 100. For instance, and as detailed further below, the housing 108 may contain, support, and/or conceal aspects that facilitate action of the air gun 100. The shape and size of the housing 108 in FIG. 1 is for illustration. Other shapes, sizes, and compositions are contemplated. Components of the housing may be made of any conventional materials, including but not limited to, metal, such as aluminum, or polymers.

FIG. 1 also illustrates that the stock 104 can include one or more removable sections 114, 116. For example, the removable sections 114, 116 can be movable relative to the stock 104 to provide access to an interior of the air gun 100. Without limitation, the can include a user interface 138. The user interface 138 is illustrated as including a number of buttons, switches, or similar interface elements that may be used to control aspects of the air gun 100. An example of the user interface 138 is illustrated in FIG. 4, described in more detail below.

FIGS. 2-9 are side views of aspects of a trigger assembly 200 that may be incorporated in the air gun 100. For example, the trigger assembly 200 may facilitate automatic cocking of the air gun 100, e.g., to allow for semi-automatic firing of the air gun 100. More specifically, FIGS. 2-9 show a progression of cocking, firing and re-cocking of the air gun 100, e.g., automatically, to enable consecutive firing of the air gun 100 without (or with minimal) user interaction.

The trigger assembly 200 is generally configured to work with a conventional pre-charged pneumatic air gun, as described further herein. Although not illustrated in FIG. 2, the air gun 100 includes a source of compressed air, e.g., a pre-charged canister (such as a compressed air canister), a cartridge (such as a CO2 cartridge), or the like. In operation, generally, the compressed air is provided to the barrel 102, e.g., via a conduit 202 (shown for example only). Not illustrated in FIG. 2, the air gun 100 further includes valves and/or other controllable components configured to allow a portion of compressed air to escape down the barrel 102, forcing a pellet or other projectile (not illustrated) arranged in the barrel 102 to be fired from the barrel 102. The trigger assembly 200 is configured to facilitate the aforementioned escape of compressed air down the barrel 102, e.g., as a shot. As detailed further herein, the trigger assembly 200 also is configured to ready the air gun 100 for firing of additional shots, e.g., automatically and without additional user manipulation, to facilitate semi-automatic firing.

The trigger assembly 200 includes the trigger 106 and a number of additional components that cooperate to fire and re-cock the air gun 100. Specifically, FIG. 2 shows an actuator 204, a primary sear 206, a secondary sear 208, and a catch 210 forming portions of the trigger assembly.

The actuator 204 is configured to move generally along, e.g., parallel to a firing axis 212. Without limitation, the firing axis 212 may be aligned with an axis of the barrel 102 and thus may be an axis along which projectiles are fired. In examples, the actuator 204 may be a hammer, although in other arrangements the actuator 204 may be at least partially formed by some other component. Without limitation, aspects of the actuator 204 may be incorporated into a valve assembly, e.g., used to fire the air gun 100.

As shown, the actuator 204 extends between a leading end 214, e.g., toward the barrel 102, and a trailing end 216. The actuator 204 may have a cylindrical sidewall, although other shapes and/or configurations are also contemplated. Moreover, and as detailed further herein, the actuator 204 can include one or more additional features, including but not limited to an engagement surface 218 offset, e.g., longitudinally, from the leading end 214 and the trailing end 216. The engagement surface 218 may cause the outer surface, e.g., a sidewall, of the actuator 204 to have a contour or surface features. The leading end 214, the trailing end 216, and the engagement surface 218 are detailed further below.

Figure 2A:
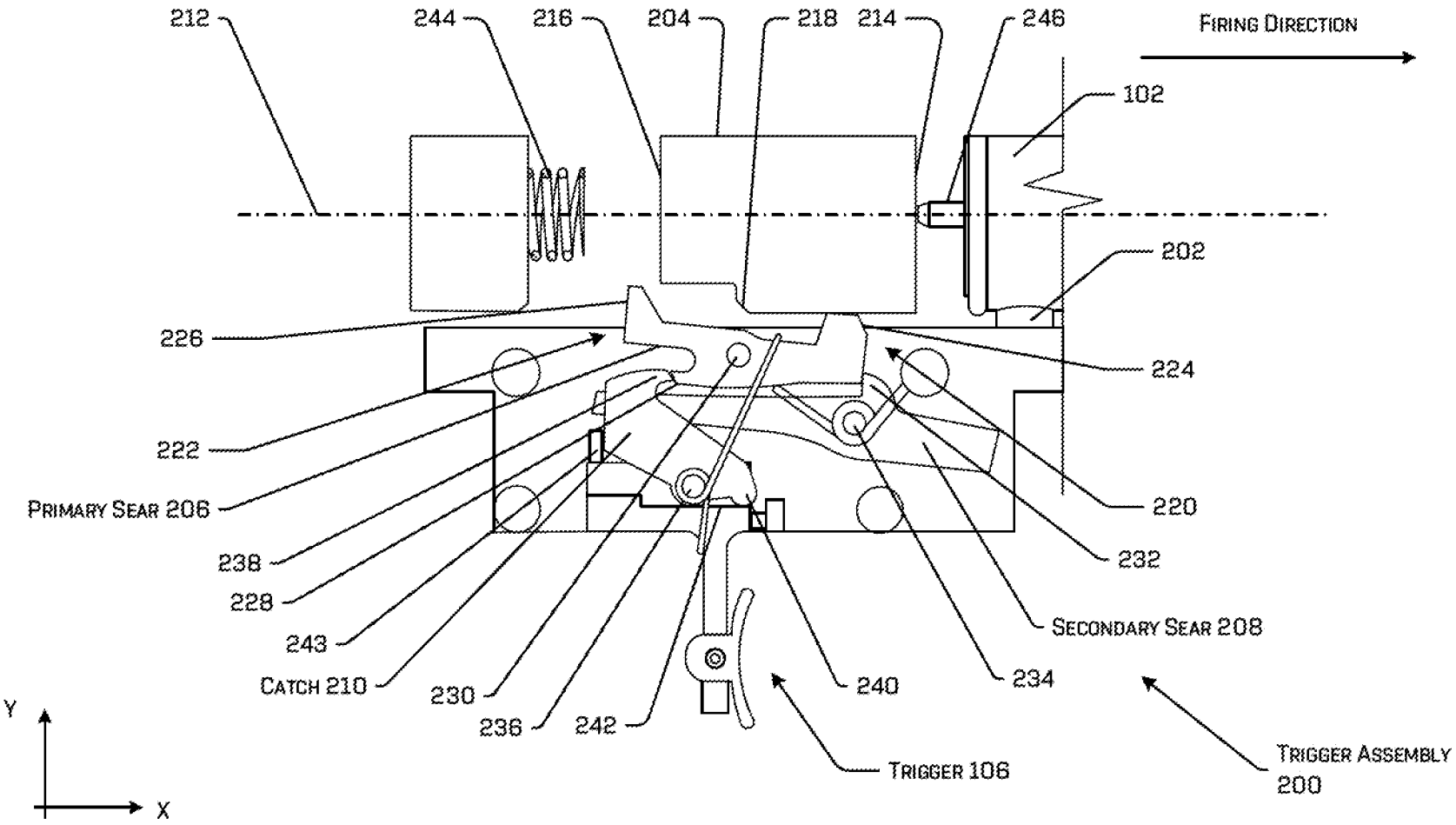
FIGS. 2A through 2H are side elevation views of aspects of a trigger assembly illustrating steps of cocking and (automatic) re-cocking of the trigger assembly according to example embodiments of the present disclosure.

The primary sear 206 is a generally elongate member, extending between a first, leading end 220 and a second, trailing end 222. The primary sear 206 includes a first protrusion 224 proximate the leading end 220. The first protrusion 224 extends generally upward (in the orientation of FIG. 2A) toward the actuator 204. The primary sear 206 also includes a second protrusion 226 proximate the trailing end 222. The second protrusion 226 extends generally upward (in the orientation of FIG. 2A) toward the actuator 204. As also shown in FIG. 2A, the primary sear 206 also includes a catch engagement 228 proximate the trailing end 222. The catch engagement 228 is illustrated as including a contoured surface proximate a lower (in the orientation of FIG. 2A) side of the body of the primary sear 206. As also illustrated in FIG. 2A, the primary sear 206 is configured to rotate about a pivot 230. More specifically, and as detailed herein, aspects of the primary sear 206, including the leading end 220, the first protrusion 224, the second protrusion 226, and/or the catch engagement 228 are configured to selectively cooperate with one or more of the actuator 204, the secondary sear 208 and/or the catch 210. For example, pivoting the primary sear 206 about the pivot 230 selectively positions aspects of the primary sear 206 to interface, interact, or otherwise cooperate with components of the trigger assembly 200, as detailed further herein.

The secondary sear 208 includes a generally elongate body and a secondary sear surface 232 extending above the elongate body. The secondary sear 208 is configured to rotate about a second pivot 234 spaced from the first pivot 230. As detailed further herein, the secondary sear surface 232 may be configured to contact the leading end 220 of the primary sear 206 in some orientations of the trigger assembly 200, as discussed further herein. More specifically, in some examples the primary sear 206 may be configured to retain the actuator 204 in a cocked position and the secondary sear 206 may be configured to retain the primary sear 206 in a desired position.

The catch 210 is configured to rotate about a third pivot 236, which is spaced from the first pivot 230 and the second pivot 234. As illustrated, the catch 210 includes a hook 238 spaced form the third pivot 236. As detailed further herein, the hook 238 is configured to cooperate with the catch engagement 228 on the primary sear 206. For example, the hook 238 may engage with the catch engagement 228 with the trigger assembly in a cocked position, e.g., to retain the primary sear 206 in a position to hold the actuator against a biasing force to fire the air gun 100.

The catch 210 also includes a cammed, trigger engagement surface 240, at an end of the catch 210 opposite the hook 238. As detailed further herein, the trigger engagement surface 240 can engage a trigger surface 242 on the trigger 106, e.g., during actuation of the trigger 106 by a user, or, and as detailed further below, during release of the trigger 106.

As also illustrated, the trigger 106 can include a trigger extension 243. In some implementations, the trigger extension 243 may be a protrusion that extends upward (in the orientation of FIG. 2A). For example, the trigger extension 243 may be a columnar member having a distal end extending a height above a portion of the trigger 106, e.g., above the trigger surface 242. As detailed further herein, the trigger extension 243 may be positioned to contact the secondary sear 208 when the trigger 106 is pulled, e.g., to cause the secondary sear 208 to disengage the primary sear 206. In examples, a height of the trigger extension may be adjustable to alter aspects of the trigger assembly 200. For example, reducing the height of the trigger extension 243 may require a longer trigger pull to fire the air gun 100.

FIG. 2A also illustrates that the air gun 100 further includes a firing spring 244, proximate the trailing end 216 of the actuator 204. As detailed further herein, the firing spring 244 is configured to bias the actuator 204 toward the barrel 102, e.g., to fire the air gun 100. FIG. 2A also shows a valve stem 246, proximate the leading end 214 of the actuator 204. Application of a force on the valve stem 246 generally in the firing direction illustrated in FIG. 2A causes compressed air to enter the barrel 102, e.g., via the conduit 202, which air escapes down the barrel 102 to fire a projectile positioned in the air flow. Although not illustrated in FIG. 2A, the valve stem 246 is biased to a rearward position (e.g., the rearward position illustrated), but the compressed air and/or by a biasing member associated with the barrel 102 or an action mechanism associated with the barrel 102. Thus, and as detailed further herein, to fire the air gun 100, the actuator 204 may be forced in the firing direction by a force from the firing spring 244. Under this force, the actuator 204 contacts the valve stem 246, causing a valve associated with the barrel 102 to open, e.g., momentarily, to allow firing the air gun 100.

In addition to the components and features just discussed and referenced in FIG. 2A, other features and functionality of the trigger assembly, as well as some modifications to these features and functionality, will be introduced and detailed further herein.

In the example of FIG. 2A, the trigger assembly 200 is in a normal or discharged configuration. For example, in the normal configuration, the trigger assembly 200 is not cocked and is not firing. The normal configuration may be a configuration in which the air gun 100 is stored, a configuration in which the air gun is maintained, e.g., to recharge the air gun and/or to load projectiles to the air gun, and/or the like. In the normal configuration, movement of the actuator 204 along the axis 212, e.g., between the firing spring 244 and the valve stem 246 may be substantially unimpeded. Also in the normal configuration, the trigger 106 is unactuated or in a neutral position. Pulling the trigger in the normal configuration may cause no appreciable action at the air gun 100.

FIGS. 2B-2H show a sequence of configurations of the trigger assembly 200 during use of the air gun 100. Throughout these figures, the same reference numbers refer to the same components, unless otherwise noted.

Figure 2B:
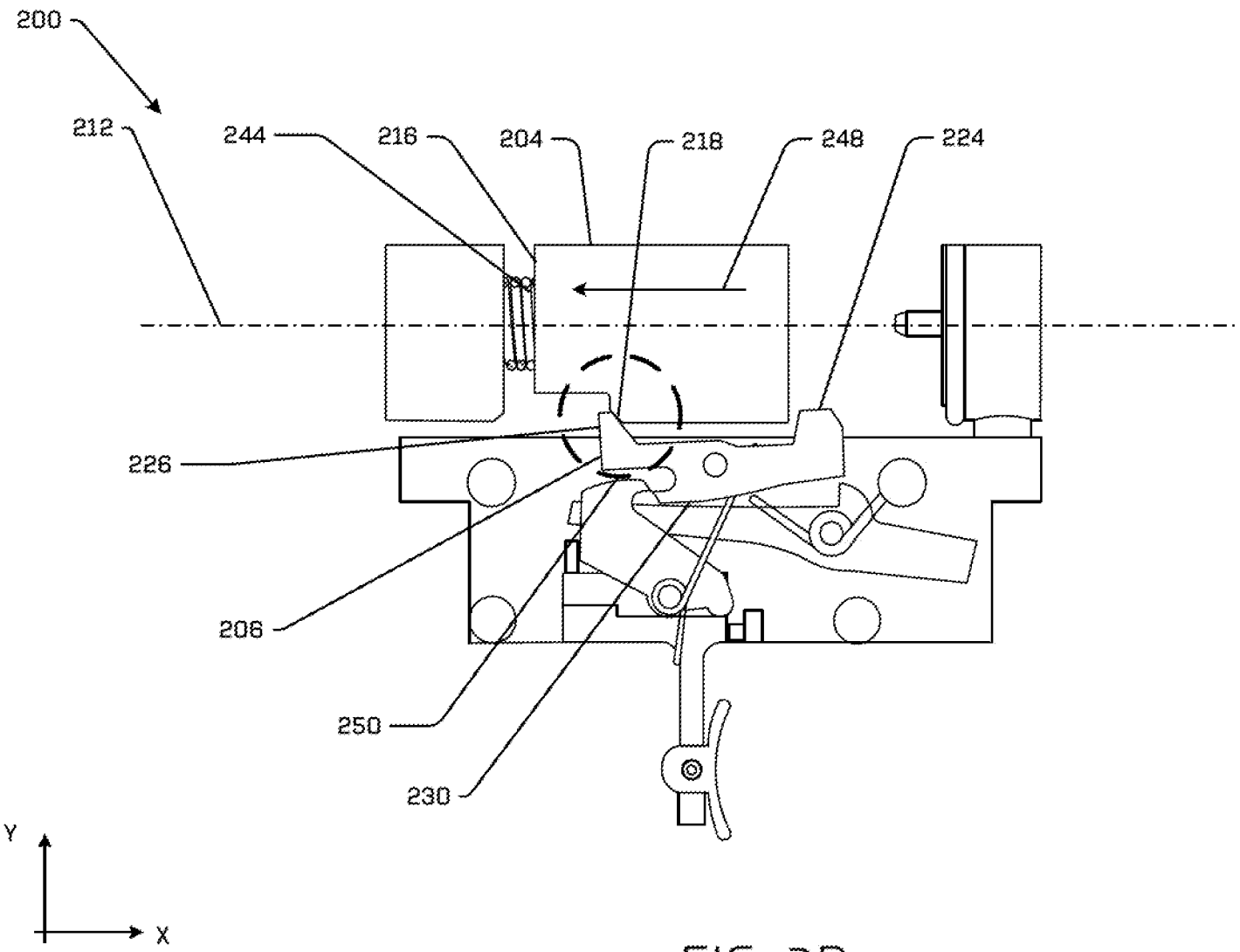

FIG. 2B shows a cocking configuration, in which the air gun is being cocked from the normal configuration shown in FIG. 2A. Specifically, in FIG. 2B, the actuator 204 is moved against the biasing force of the firing spring 244 to compress the firing spring 244. Specifically, the actuator 204 is moved generally in the direction of an arrow 248 (opposite the firing direction shown in FIG. 2A) such that the trailing end 216 of the actuator 204 abuts the firing spring 244. Continued movement of the actuator 204 in the direction causes the actuator 204 to compress the firing spring 244. For example, and although not illustrated in the FIGS., the air gun 100 may further include a manual interface, e.g., as a bolt, a slide, or the like, associated with the actuator 204. A user may interact with the manual interface to move the actuator 204 into the position shown in FIG. 2B. In at least some examples, the movement of the actuator 204 may also facilitate loading of a projectile into a firing position in or proximate the barrel 102. In examples, the trigger assembly 200 and associated functionality may be used with any manner of loading projectiles, including manual, semi-automatic, or automatic feeding. In some examples, the cocking force required to overcome the biasing force of the firing spring 244 may be provided by an automatic cocking mechanism, such as an electromagnetic slide, or the like.

In addition to compressing the firing spring 244, and as shown in the highlighted section 250 of FIG. 2B, movement of the actuator 204 along the direction of the arrow 248 also causes the engagement surface 218 to engage the second protrusion 226 of the primary sear 206. As illustrated, the engagement surface 218 is an angled surface, and the second protrusion 226 includes a complementary angled surface. As illustrated in FIG. 2B, the contact of the engagement surface 218 with the second protrusion 226 causes the primary sear 206 to pivot about the first pivot 230, e.g., in counterclockwise direction. As a result of this pivoting, the first protrusion 224 of the primary sear 206 moves upward. As shown, the primary sear 206 may pivot such that the first protrusion 224 is disposed in an upward position in a path of travel of the actuator 204, e.g., should the actuator 204 move in the firing direction.

Figure 2C:
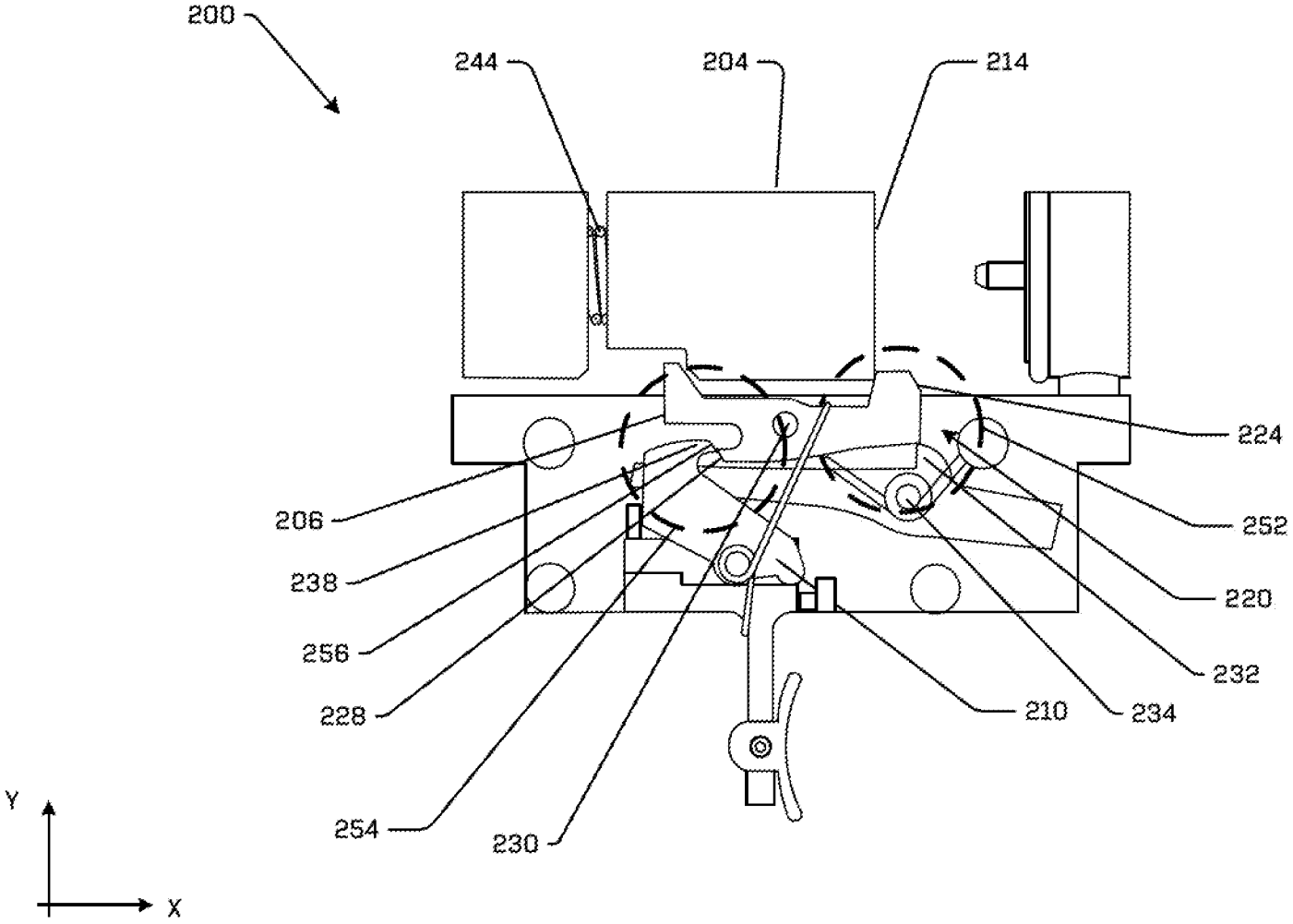

FIG. 2C shows the trigger assembly 200 in a cocked position. Specifically, in the example of FIG. 2C, the (cocking) force applied in the example of FIG. 2B to overcome the bias of the firing spring 244 is removed. As noted, during cocking, the primary sear 206 pivots such that the first protrusion 224 (at the leading edge 220 of the primary sear 206) is in a path of travel of the actuator 204. With the cocking force removed, the force of the firing spring 244 biases the actuator 204 in the firing direction. As shown in the highlighted section 252 of FIG. 2C, the leading surface 214 of the actuator 204, under the force of the firing spring 244, contacts the first protrusion 224 to maintain the actuator 204 against the spring force of the firing spring 244.

Moreover, and as also illustrated in the highlighted portion 250, the secondary sear 208 is positioned such that the secondary sear surface 232 is disposed under the leading end 220 of the primary sear 206. As detailed above, the secondary sear 208 is configured to rotate about the second pivot 234. In this example, the force transferred from the primary sear 206 to the second sear, e.g., at the secondary sear surface 232 is substantially aligned with the pivot 234, such that minimal rotational force is applied to the secondary sear 208, e.g., about the second pivot 234. In examples, a biasing spring or the like may be sufficient to offset any rotational force resulting from contact of the primary sear 206 with the secondar sear 208.

The catch 210 may also assist in maintaining the primary sear 206 in the illustrated cocked position. Specifically, and as shown in the highlighted section 254, an outer surface 256 of the hook 238 contacts a surface of the catch engagement 228. The outer surface 256 of the hook 238 and the surface of the catch engagement 228 are facing surfaces that offset the angular force applied on the primary seal 206 by the actuator 204 from the firing spring 244. More specifically, and as will be appreciated, the actuator 204 is under a linear force, e.g., along the axis 212 from the firing spring 244. This force is transferred from the actuator 204 to the primary sear 206, at the interface of the leading surface 214 of the actuator and the first protrusion 224 of the primary sear 206. This force imparts a rotational force on the primary sear 206, e.g., that would cause the primary sear 206 to rotate clockwise about the first pivot 230. This rotational force is offset, at least partly, by the interface between the hook 238 and the catch engagement 228.

Figure 2D:
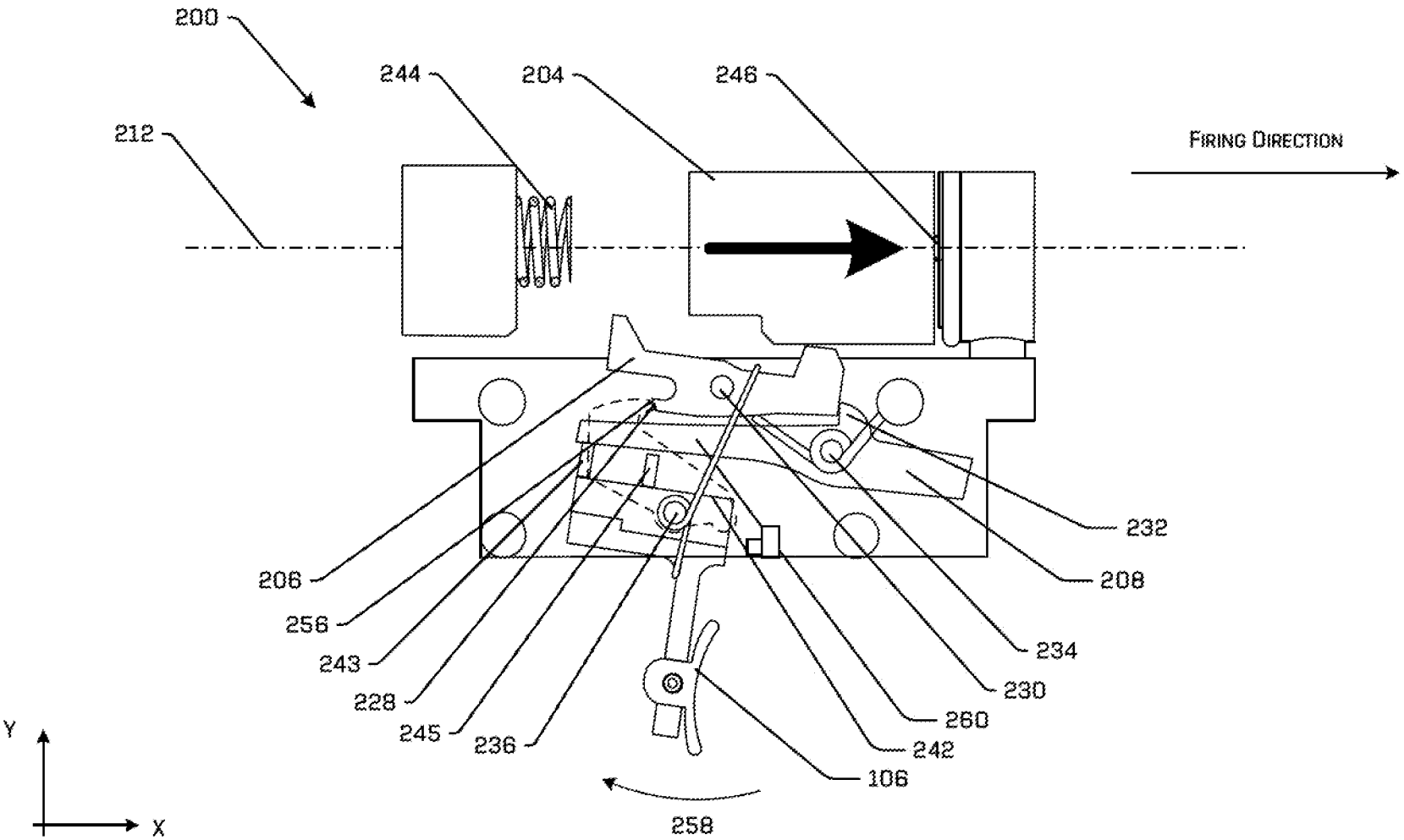

FIG. 2D shows a firing configuration of the trigger assembly 200. Specifically, in FIG. 2D, a user has engaged the trigger 106, causing the trigger 106 to pivot clockwise about the third pivot 236, generally in the direction shown by the arrow 258. With continued movement of the trigger 106 in the direction of the arrow 258, the trigger extension 243 contacts an underside of a trailing arm 260 of the secondary sear 208. The trigger extension 243 imparts a rotational force on the secondary sear 208, causing the secondary sear 208 to rotate in a clockwise direction about the second pivot 234. This rotation, in turn, causes the secondary sear surface 232 to rotate relative to the primary sear 206, to the position of FIG. 2D. In this position, the secondary sear 208 no longer supports the primary sear 206 in the cocked position. With the secondary sear 208 no longer in position to counteract the force applied on the primary sear 206 by the actuator 204, the primary sear 206 rotates about the first pivot 230, e.g., in a clockwise direction, such that the actuator 204 is allowed to advance, under the biasing force, in the firing direction. The biasing force, unchecked by the primary sear 206, causes the actuator 204 to advance with sufficient force to displace the valve stem 246, thereby causing compressed air to rush through the barrel 102 to fire the air gun 100.

FIG. 2D also shows an optional second trigger extension 245. Like the trigger extension 243, the second trigger extension 245 may be a protrusion that extends upward (in the orientation of FIG. 2D). For example, the trigger extension 243 may be a columnar member having a distal end extending a height above a portion of the trigger 106, e.g., above the trigger surface 242. Like the trigger extension 243, the second trigger extension 245 may be positioned to contact the secondary sear 208 when the trigger 106 is pulled, e.g., to cause the secondary sear 208 to disengage the primary sear 206. In the example, the second trigger extension 245 is relatively closer to the pivot 236 about which the trigger 106 pivots. In examples, a height of the second trigger extension 245 may also be adjustable to alter aspects of the trigger assembly 200. For example, the heights of the trigger extension 243 and the second trigger extension 245 may cooperate to adjust aspects of use of the trigger assembly 200. For example, the pulling the trigger 106 as described may cause the second trigger extension 245 to first contact the secondary sear 208 and begin rotation of the secondary sear 208, e.g., about the pivot 234, and then the first trigger extension 243 may contact the secondary sear 208 to continue rotation of the secondary sear 208. In examples, the use of the second trigger extension 245, with the trigger extension 243, may allow for a different "feel" to a user pulling the trigger 106.

As shown in FIG. 2D, the primary sear 206 rotates to a position in which the secondary sear surface 232 of the secondary sear 208 is in front of the leading end 220 of the primary sear 206, that is, no longer engaging, as discussed above. However, the surface 256 of the hook 238 of the catch 210 and the engagement surface 228 of the primary sear may remain in contact, e.g., as the catch 210 rotates with the primary sear 206.

Figure 2E:
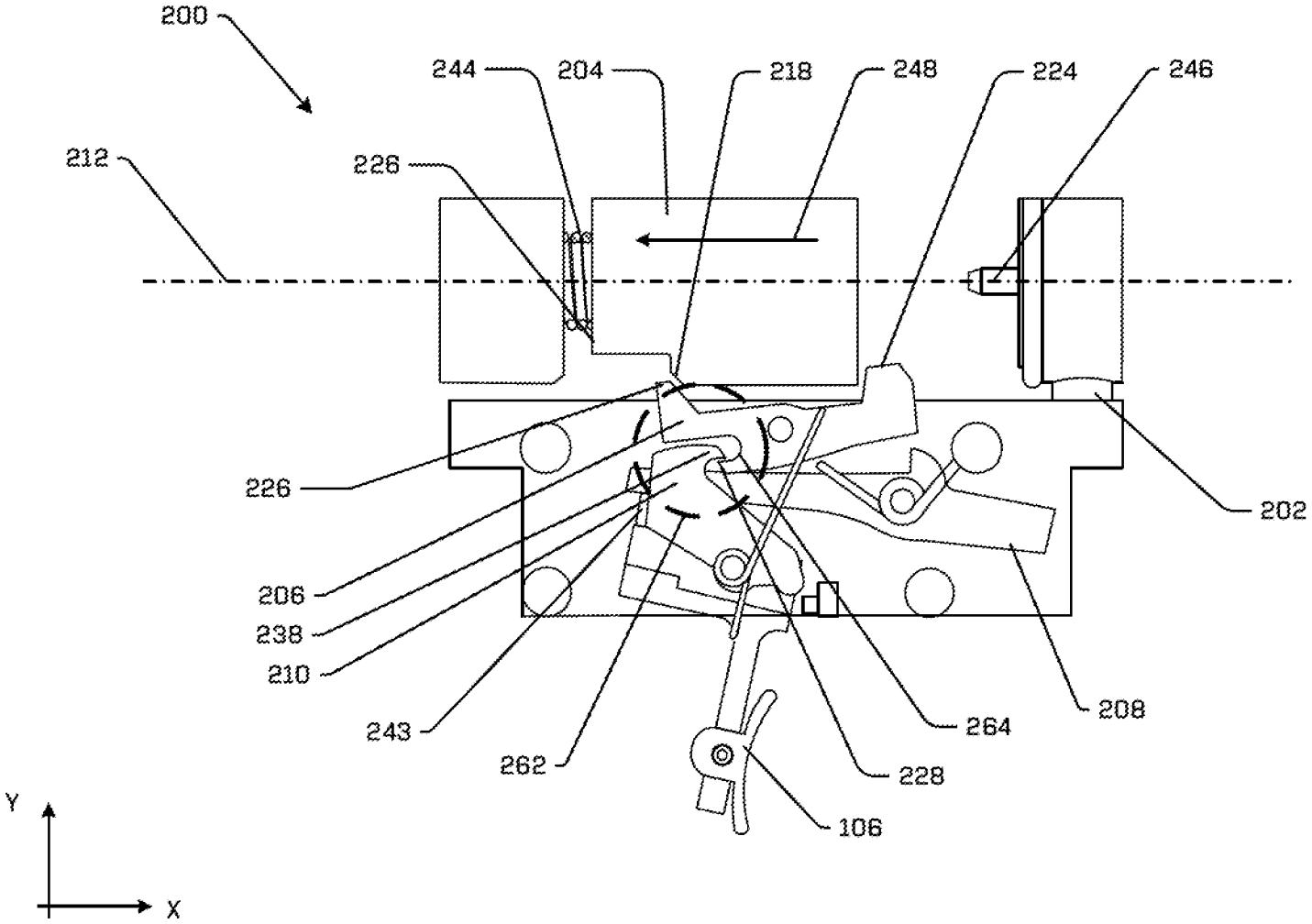

As noted above, the valve stem 246 is biased to an extended position shown in FIG. 2A. Under sufficient force, as just detailed, the valve stem 246 deflects (in the firing direction), causing air to rush into and through the barrel 102, e.g., via the conduit 202 to fire the air gun 100. Once fired, the biasing force on the valve stem 246 causes the valve stem 246 to return to the extended position, generally as shown in FIG. 2E. More specifically, FIG. 2E shows an automatic cocking configuration. In this configuration, the valve stem 246 may exert a sufficient force on the actuator 204 to cause the actuator to return toward the firing spring 244 and at least partially compress the firing spring 244. In some examples, the actuator 204 may also or alternatively be forced toward the firing spring 244 by compressed air. For example, some of the compressed air that passes through the conduit 202 to fire the air gun 100 may instead pass through an opening in a direction toward the actuator 204. Although not visible in FIG. 2E, a clearance may exist around the valve stem 246 through which some of the compressed air used to fire the air gun 100 may pass. In some examples, to facilitate sufficient force by this "back flow" air, the conduit 202 may be sized to provide air at a pressure and/or volume sufficient to both fire the air gun 100 and force the actuator 204 rearward, as shown in FIG. 2E. In examples, the force applied by the valve stem 246 and/or the "back flow" air on the actuator mimics the cocking force applied along the direction of the arrow 248 to cock the air gun 100, discussed above in connection with FIG. 2B. Like in the cocking configuration of FIG. 2B, as the actuator 204 is forced in the direction of the arrow 248, against the force of the firing spring 244, the engagement surface 218 of the actuator 204 contacts the second protrusion 226 of the primary sear 206, causing the primary sear 206 to rotate in a counterclockwise direction. Also as in the example of FIG. 2B, the first protrusion 224 at the leading end 220 of the primary sear 206 extends upward, into a travel path of the actuator 204, as the primary sear rotates.

Unlike the configuration of FIG. 2B, however, in the configuration of FIG. 2E the trigger 106 remains pulled, such that the trigger extension 243 continues to contact the secondary sear 208, and retain the secondary sear 208 in the rotated position of FIG. 2C, e.g., such that the secondary sear 208 does not support the primary sear 206 from rotating in the clockwise direction. Instead, in the configuration of FIG. 2E, as shown in a highlighted portion 262, the hook 238 of the catch 210 disengages from the primary sear 206 as the primary sear 206 rotates, such that a distal end of the hook 238, including the surface 256, is disposed in a notch 264 of the primary sear 206. The notch 264 may be formed in the primary sear 206 proximate the catch engagement 228. In more detail, and as shown in the highlighted portion 262, a downward-facing (e.g., bottom) surface of the hook 238 contacts an upward-facing (e.g., top) surface of the catch engagement 228, defined at least partially by the notch 264.

Figure 2F:
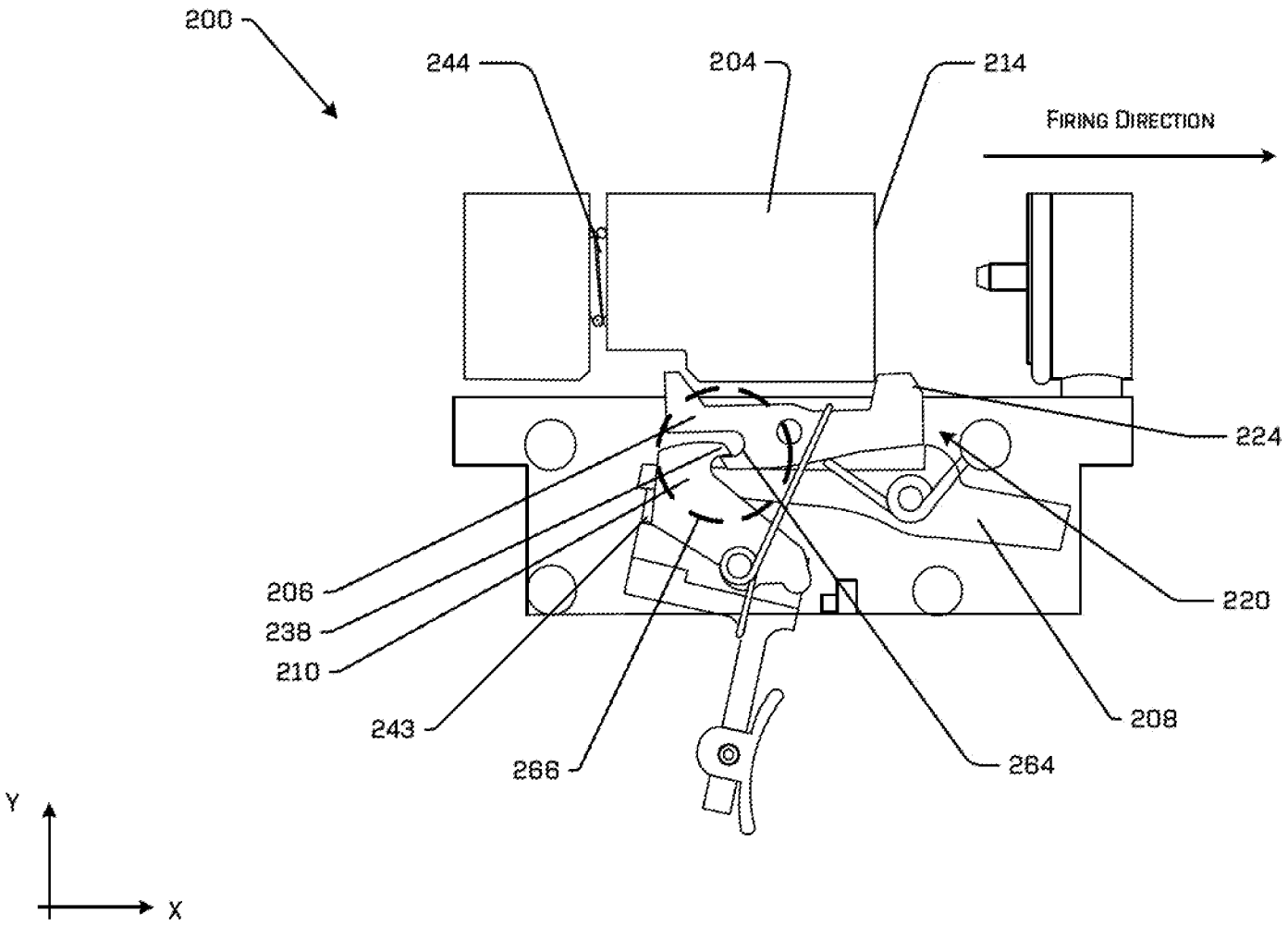

Once the actuator 204 contacts (and compresses) the firing spring 244, the biasing force of the firing spring 244 will bias the actuator 204, in the firing direction. As just discussed in connection with FIG. 2E, when the actuator 204 is forced back by the valve stem 246, the primary sear 206 pivots such that the first protrusion 224 (at the leading edge 220 of the primary sear 206) is in a path of travel of the actuator 204. As shown in FIG. 2F, which is similar to the example of FIG. 2C discussed above, in this arrangement the leading surface 214 of the actuator 204, under the force of the firing spring 244, contacts the first protrusion 224 to maintain the actuator 204 against the spring force of the firing spring 244. Unlike in the example of FIG. 2C, in FIG. 2F the secondary sear 208 is not positioned such that the secondary sear surface 232 is disposed under the leading end 220 of the primary sear 206, e.g., because the trigger is still pulled. Accordingly, the secondary sear 208 does not resist motion of the primary sear 206. Instead, the distal end of the hook 238, including the surface 256, is disposed in the notch 264 of the primary sear 206 to resist the force biasing the primary sear 206 to rotate, generally shown at the highlighted portion 266 in FIG. 2F.

Figure 2G:
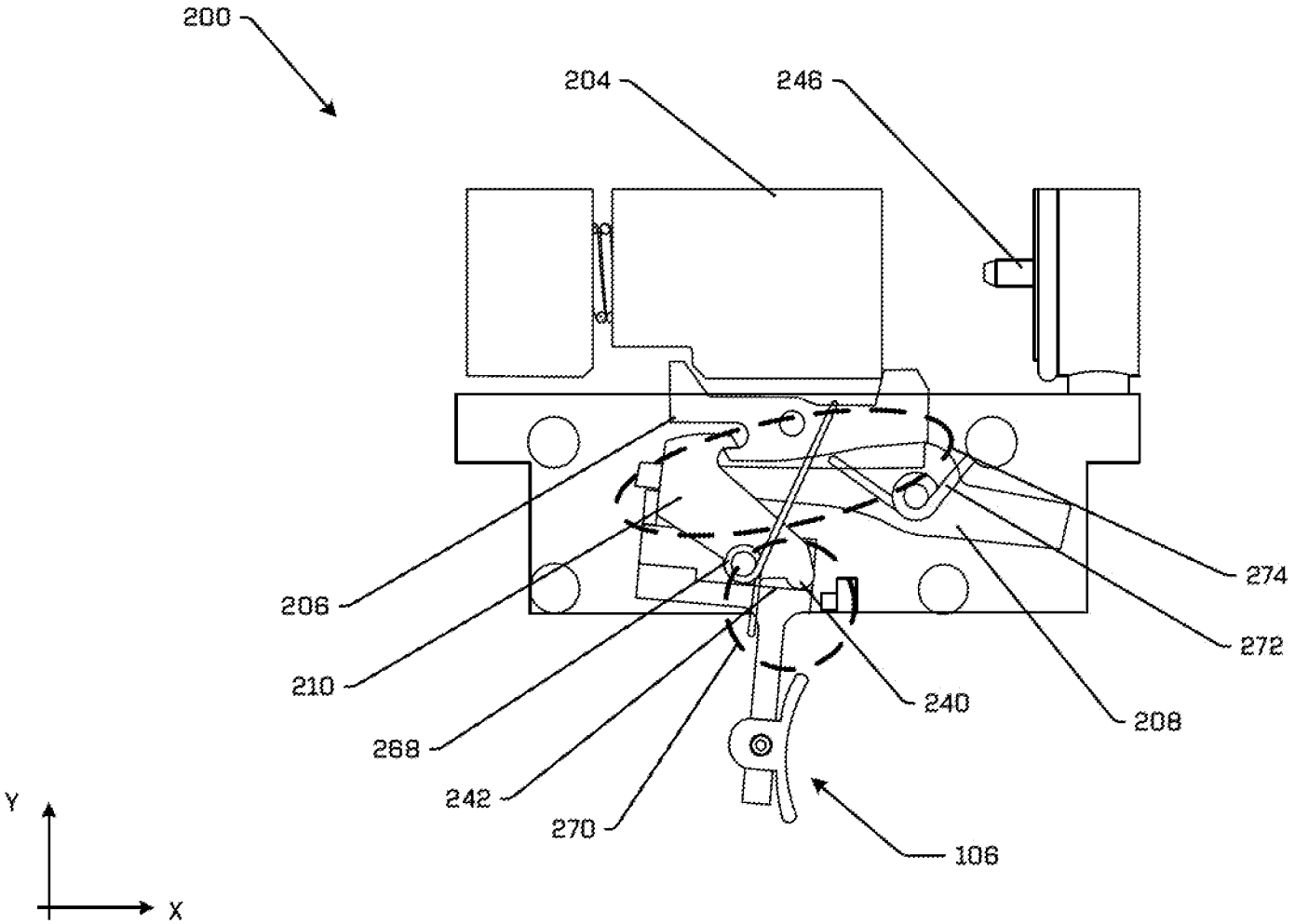
Figure 2H:
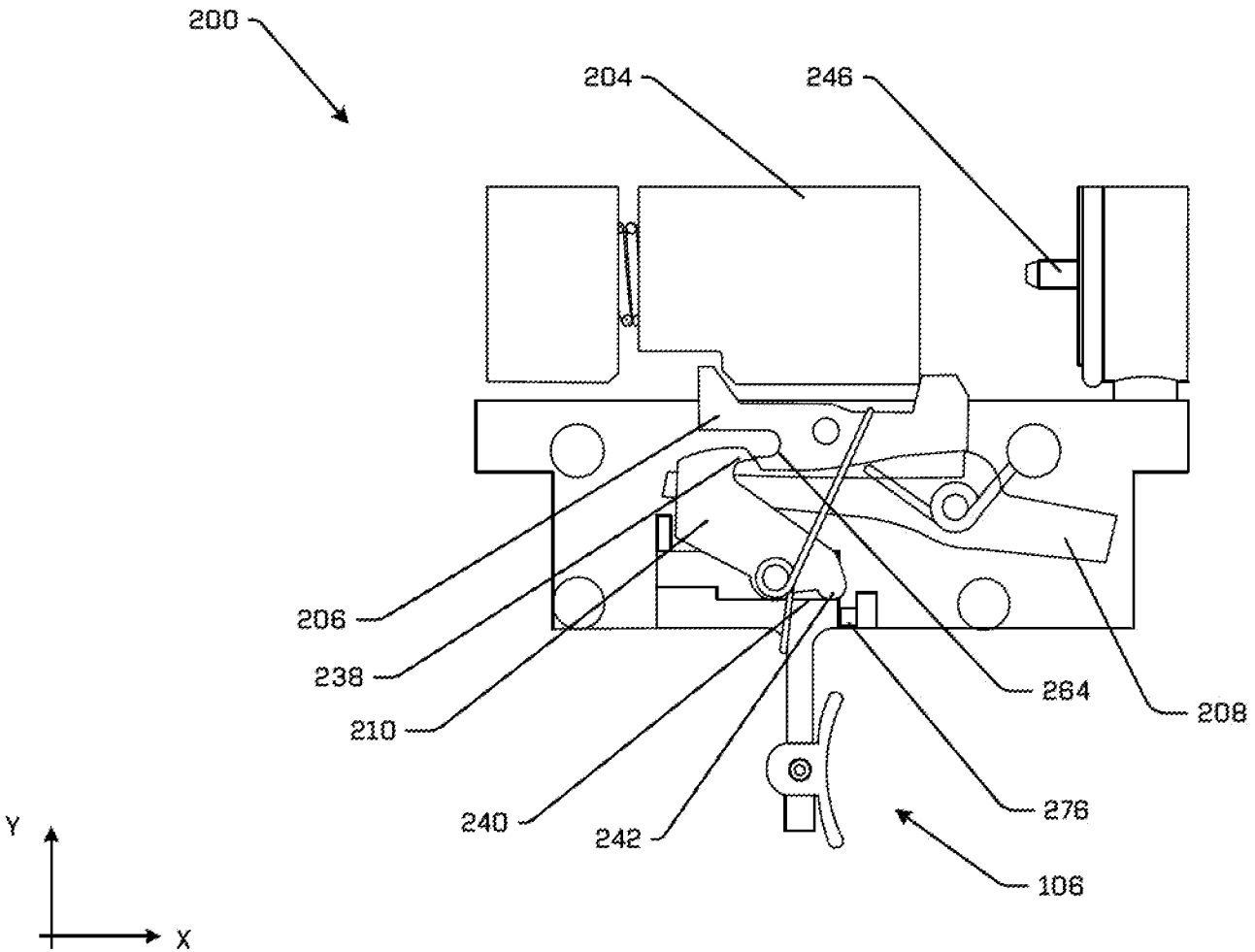

In the example of FIG. 2F, the actuator 204 is retained in the cocked position, but the trigger is already "pulled." FIGS. 2G and 2H show the progression of resetting the trigger, e.g., to a normal or unpulled orientation, while maintaining the actuator 204 in the cocked and ready-for-firing position. Conceptually, FIGS. 2G and 2H illustrate steps in a "hand-off" of the force that counters the biasing force resulting from the firing spring 244 from the hook 238 (of the catch 210) to the secondary sear 208.

In FIG. 2G, the trigger has been released and moves toward the normal, unpulled position. For example, a trigger return spring 268 may bias the trigger 106 to rotate counterclockwise in the example orientation of FIG. 2G. Thus, when pulling the trigger 106 to fire the trigger assembly 200, the user will overcome the biasing force of the trigger return spring 268. Also in FIG. 2G, the biasing of the trigger 106 in the counterclockwise direction causes the catch 210 to rotate in the counterclockwise direction. Specifically, the trigger surface 242 of the trigger 106 contacts the trigger engagement surface 240 of the catch, which in turn forces the counterclockwise rotation of the catch 210. This interaction is generally illustrated at first highlighted portion 270 in FIG. 2G. As will be appreciated, continued counterclockwise rotation of the catch 210 will cause the hook 238 to disengage from the notch 264 of the primary sear 206.

As also illustrated in FIG. 2G, in addition to biasing the catch 210, the counterclockwise rotation of the trigger 106, as the trigger returns to the unpulled or normal position, will also cause the trigger extension 243 to rotate counterclockwise. When the trigger 106 was in the pulled position, the trigger extension 243 was maintaining the secondary sear in a clockwise position, e.g., against a biasing force of a secondary sear spring 272. In the clockwise position, the secondary sear 208 is unable to support the primary sear 206, as discussed further herein. Releasing the trigger 106 by allowing the trigger 106 to rotate counterclockwise, also allows the secondary sear 208 to rotate (also counterclockwise in the example shown). More specifically, the movement of the trigger extension 243 allows for a corresponding movement of the secondary sear 208, under the force of the secondary spring sear 272. This movement of the secondary sear 208 positions the secondary sear surface 232 under the primary sear 206. The highlighted portion 274 of FIG. 2G shows the movement of the trigger extension 243 and the secondary sear 208, with the secondary sear surface 232 in a position to support the primary sear 206.

FIG. 2H shows continued rotation of the trigger 106 to a normal or ready-for-firing position. More specifically, in FIG. 2H, the biasing force of the trigger return spring 268 has continued rotation of the trigger 106 in the counterclockwise direction to the normal position. In the normal position, a trigger stop 276 resists continued (counterclockwise) rotation of the trigger 106. The trigger stop 276 may be adjustable, e.g., to facilitate setting of a preferred orientation of the trigger 106 in the normal position. In examples, the trigger stop 276 can include a set screw or the like, which is fixed relative to the air gun 100.

The continued rotation illustrated by FIG. 2H has also caused the trigger surface 242 to continue to interface with the trigger engagement surface 240, to continue counterclockwise rotation of the catch 210. Specifically, the catch 210 is rotated to a position at which the hook 238 disengages from the notch 264 of the primary sear 206. Accordingly, in the example of FIG. 2H, the catch 210 no longer counters the biasing force on the primary sear 206 applied by the actuator 204. Instead, the secondary sear 208, which is now positioned under the primary sear 206, counters this biasing force. As will be appreciated, the configuration of FIG. 2H corresponds to the cocked and ready for firing configuration of FIG. 2C. Thus, FIGS. 2D-2H illustrate firing and automatic re-cocking of the trigger assembly 200, without any user interaction beyond pulling (and subsequently releasing) the trigger.

In the example configurations of FIGS. 2G and 2H, the return of the trigger 120 to the unbiased position is caused by the trigger return spring 268. The interface of the trigger surface 242 with the trigger engagement surface 240 causes movement of the catch 210 and thus disengagement of the catch 210 from the primary sear 206. As noted above, the trigger engagement surface 240 is cammed to facilitate a desired release of the catch 210 from the primary sear 206. In the example, the trigger engagement surface 240 has an arcuate surface, although, and as will be appreciated, modifications to the surface can result in varied disengagement times and/or movement patterns relative to return of the trigger 106 to the neutral or non-actuated position.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the spirit and scope of the present invention, which is set forth in the following claims.

I claim:

1. A trigger assembly comprising:

an actuator configured to move along a longitudinal axis, the actuator having a leading surface and a trailing surface;

a primary sear configured to rotate about a first pivot, the primary sear including a first protrusion proximate a leading end of the primary sear and a second protrusion proximate a trailing end of the primary sear, the primary sear further comprising a catch engagement surface proximate the trailing end of the primary sear;

a catch configured to rotate about a second pivot spaced from the first pivot;

a trigger configured to pivot about the second pivot relative to the catch; and a secondary sear configured to rotate about a third pivot, wherein:

with the trigger assembly in a cocked configuration, the first top protrusion of the primary sear contacts the leading surface of the actuator to retain the actuator in a cocked position and the secondary sear contacts the primary sear to resist pivoting of the primary sear, in response to rotation of the trigger about the second pivot to a firing position, the trigger contacts the secondary sear, causing the secondary sear to rotate about the third pivot to facilitate movement of the primary sear about the first pivot, the movement of the primary sear about the first pivot causing the first top protrusion of the primary sear to release the actuator, the release of the actuator causes the actuator to move along the barrel axis in a first direction to fire the air gun, after firing of the air gun, the actuator moves in a second direction along the barrel axis to contact the second protrusion of the primary sear, causing the primary sear to pivot about the primary sear to a re-cocking position in which the catch engagement surface of the primary sear engages the catch and the catch retains the primary sear in a position to contact the leading surface of the actuator with the first protrusion of the primary sear, and releasing the trigger with the catch engaged causes, in order, the secondary sear to return to a position that engages the primary sear and causes the catch to disengage from the catch engaging surface, thereby placing the air gun in the cocked configuration.

2. The trigger assembly of claim 1, wherein:

the trigger comprises a trigger blade;

the catch comprises a cammed surface; and releasing the trigger causes the trigger blade to engage with the cammed surface to cause the catch to disengage from the catch engaging surface of the primary sear.

3. The trigger assembly of claim 1, wherein:

the actuator comprises an engagement surface offset from the trailing end of the actuator; and the engagement surface contacts the second protrusion of the primary sear.

4. The trigger assembly of claim 1, further comprising:

a biasing member biasing the trigger to a neutral position, wherein, in the neutral position, a trigger blade biases the catch out of engagement with the primary sear.

5. The trigger assembly of claim 4, further comprising:

a trigger stop configured to retain the trigger in the neutral position against a force of the biasing member.

6. The trigger assembly of claim 4, further comprising a trigger extension extending from the trigger, the trigger extension being adjustable to configure a distance between the trigger extension and the secondary sear.

7. The trigger assembly of claim 1, further comprising:

a biasing member biasing the secondary sear into a position to contact the primary sear to retain the hammer in the cocked position.

8. The trigger assembly of claim 1, wherein the actuator comprises a hammer.

9. The trigger assembly of claim 1, further comprising:

a firing spring disposed along the barrel axis, proximate the trailing surface of the actuator, wherein the trailing surface of the actuator is held against a biasing force of the firing spring in the cocked position; and a valve stem disposed along the barrel axis, proximate the leading surface of the actuator, the valve stem configured to provide a return force on the actuator to cause the actuator to move in the second direction along the barrel axis.

10. An air gun comprising:

a barrel;

a compressed air source in fluid communication with the barrel;

a valve configured to selectively allow compressed air from the compressed air source into the barrel; and a trigger assembly configured to selectively open the valve to pass compressed air from the compressed air source to the barrel to fire a projectile, the trigger assembly comprising:

an actuator biased by a firing spring toward the barrel along a longitudinal axis;

a primary sear configured to rotate about a first pivot;

a secondary sear configured to rotate about a second pivot spaced from the first pivot;

a catch configured to rotate about a third pivot spaced from the first pivot and the second pivot; and a trigger configured to pivot about the third pivot, relative to the catch, wherein:

the secondary sear holds the primary sear in a first position contacting the actuator to retain the actuator in a cocked position against a biasing force of a firing spring with the trigger in a normal position, the catch holds the primary sear in the first position contacting the actuator to retain the actuator in a re-cocking position against a biasing force of the firing spring with the trigger in a pulled position, and returning the trigger from the pulled position to the normal position with the actuator in the re-cocking position causes, in order, the secondary sear to engage the primary sear and the catch to disengage from the primary sear.

11. The air gun of claim 10, further comprising:

a valve stem associated with the valve and disposed proximate the barrel, the valve stem configured to provide a return force on the actuator to cause the actuator to move toward the firing spring, to the re-cocking position.

12. The air gun of claim 11, wherein:

with the trigger assembly in the cocked configuration, a first protrusion of the primary sear contacts a leading surface of the actuator to retain the actuator in the cocked position and the secondary sear contacts the primary sear to resist pivoting of the primary sear about the first pivot, in response to rotation of the trigger about the third pivot to the pulled position, the trigger contacts the secondary sear, causing the secondary sear to rotate about the second pivot to facilitate movement of the primary sear about the first pivot, the movement of the primary sear about the first pivot causing the first protrusion of the primary sear to release the actuator, the release of the actuator causes the actuator to move along the barrel axis in a first direction to contact the valve stem and fire the air gun, after firing of the air gun, the actuator moves in a second direction along the barrel axis to contact a second protrusion of the primary sear, causing the primary sear to pivot about the first pivot to a position in which a catch engagement surface of the primary sear engages the catch and the catch retains the primary sear in a position to contact the leading surface of the actuator with the first protrusion of the primary sear, retaining the actuator in the re-cocking position, and releasing the trigger with the catch engaged causes, in order, the secondary sear to return to a position that engages the primary sear and causes the catch to disengage from the catch engaging surface, thereby placing the air gun back in the cocked configuration.

13. The air gun of claim 11, wherein:

the trigger comprises a trigger blade;

the catch comprises a cammed surface; and releasing the trigger causes the trigger blade to engage with the cammed surface to cause the catch to disengage from the catch engaging surface of the primary sear.

14. The air gun of claim 13, further comprising:

a biasing member biasing the trigger to a neutral position, wherein, in the neutral position, a trigger blade biases the catch out of engagement with the primary sear.

15. The air gun of claim 12, wherein: the actuator comprises an engagement surface offset from the trailing end of the actuator; and the engagement surface contacts the second protrusion of the primary sear.

* * * * *